US005701930A

United States Patent [19]

Russell

[11] Patent Number: 5,701,930

[45] Date of Patent: Dec. 30, 1997

[54] MODULAR VALVE ASSEMBLY

[76] Inventor: Robert L. Russell, 979 Walnut Ridge Ct., Frankfort, Ill. 60423

[21] Appl. No.: 431,893

[22] Filed: May 1, 1995

[51] Int. Cl.[6] ..... F16K 43/00; F16K 1/00; F01L 3/00

[52] U.S. Cl. ..... 137/454.5; 29/213.1; 29/890.124; 123/188.2; 123/189; 251/263; 251/337

[58] Field of Search ..... 123/90.6, 90.65, 123/90.66, 90.67, 188.2, 188.12, 188.13, 188.17, 188.5, 189; 251/251, 263, 337; 137/315, 454.2, 454.5, 454.6; 29/213.1, 214, 221.6, 402.03, 402.08, 890.121, 890.124

[56] References Cited

U.S. PATENT DOCUMENTS

| | | | |
|---|---|---|---|
| 713,147 | 11/1902 | Power | 123/189 |
| 866,002 | 9/1907 | Daellenbach | 123/188.2 |
| 1,034,708 | 8/1912 | Henry | 123/188.2 |
| 1,077,795 | 11/1913 | Bruns | 123/188.2 |
| 1,218,010 | 3/1917 | Soss | 251/263 |
| 1,331,826 | 2/1920 | Shepherd | 123/90.66 |
| 1,427,111 | 8/1922 | Knudsen | 123/90.67 |
| 1,457,957 | 6/1923 | Birkigt | 251/337 |
| 1,473,711 | 11/1923 | Sherbondy | 251/263 |
| 1,530,372 | 3/1925 | Kastner | 123/189 |
| 1,664,375 | 3/1928 | Howard | 123/188.1 |
| 1,752,790 | 4/1930 | Estep | 123/189 |
| 1,774,928 | 9/1930 | Land | 123/189 |
| 1,815,134 | 7/1931 | Weiner et al. | 123/90.6 |
| 1,862,283 | 6/1932 | Schoetzow | 251/337 |
| 1,969,954 | 8/1934 | Taylor | 123/188.2 |
| 2,250,793 | 7/1941 | Feick | 251/337 |
| 2,354,988 | 8/1944 | Fix | 123/188.2 |
| 2,647,501 | 8/1953 | Rich | 251/337 |
| 2,667,155 | 1/1954 | Paluch et al. | 123/189 |
| 2,706,470 | 4/1955 | Sills | 123/188.2 |
| 2,827,032 | 3/1958 | Wiknich | 123/189 |
| 3,447,524 | 6/1969 | Pfleghaar | 123/189 |
| 3,479,007 | 11/1969 | Buell | 123/188.2 |
| 5,357,914 | 10/1994 | Huff | 123/188.2 |

FOREIGN PATENT DOCUMENTS

| | | | |
|---|---|---|---|
| 15936 | of 1903 | United Kingdom | 123/188.2 |

*Primary Examiner*—George L. Walton
*Attorney, Agent, or Firm*—McCaleb, Lucas & Brugman

[57] ABSTRACT

A pre-assembled valve mechanism for use in valve controlled internal combustion engines and the like which is constructed and arranged to be installed and removed quickly as a unitary module with minimum effort and expenditure of time; the module comprising a cylindrical housing with valve seat and exhaust port, a headed valve cooperable with the seat, a valve guide, a return spring and a valve actuating cam follower coaxially mounted in operating position with the housing.

8 Claims, 4 Drawing Sheets

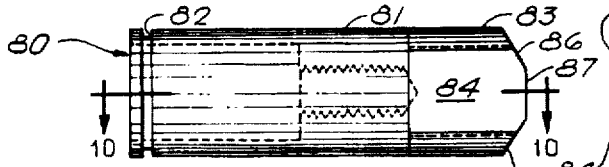
FIG. 11
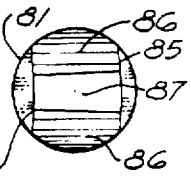
FIG. 12
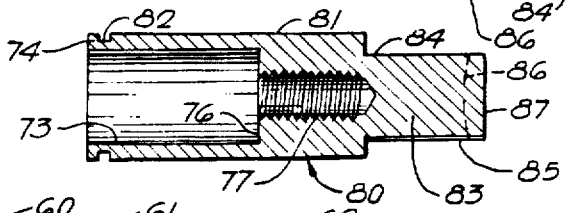
FIG. 10
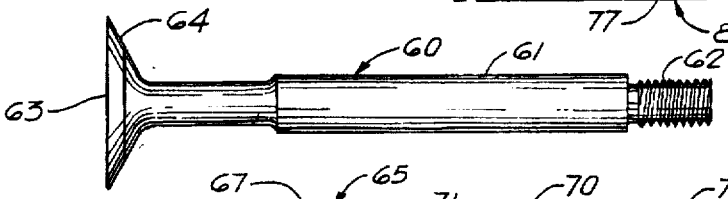
FIG. 9
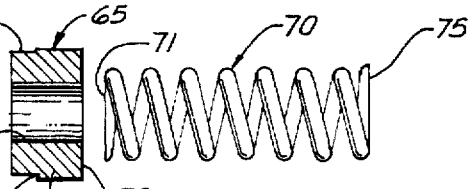
FIG. 7
FIG. 8
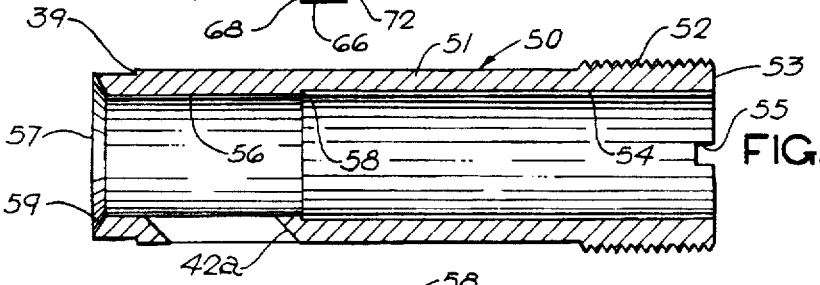
FIG. 6
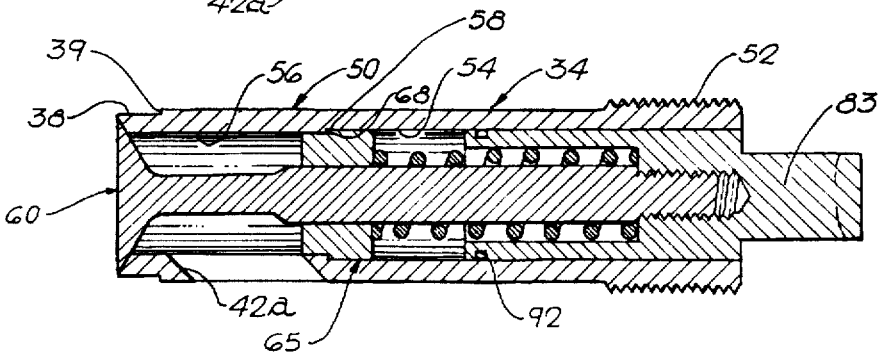
FIG. 5

MODULAR VALVE ASSEMBLY

This invention relates generally to valve mechanisms useful with either intake or exhaust ports of internal combustion engines, pumps and the like and more particularly is directed to a novel self-contained unitary valve module.

In the typically familiar internal combustion engine, by way of general example, intake and exhaust valves for controlling combustion and exhaust cycles of the engine are mounted over intake and exhaust ports to control the inflow of combustible fuel mixtures and the outflow of exhaust gases. Frequently, such ports usually have annular permanent or insert valve seats engageable with the head of an associated mushroom type valve having an elongated valve stem and return spring coupled between the valve stem and a fixed support for holding the valve head closed against its seat. A rotatably driven cam commonly engages the lower end of the valve stem or an intervening lift rod periodically to compress the return spring and lift the valve head off its seat.

In the event of valve failure, such as a warped or broken valve head or stem, scored valve seat, defective return spring or like fault, repairing the defective valve is not only time and labor intensive, but in many cases entails extensive tear down of the engine itself. In severe cases the condition of the engine may dictate complete engine replacement.

In recognition of the foregoing problems attending presently known valve assemblies the present invention provides a unitary valve mechanism comprising a module including a valve, valve seat, valve stem, return spring, cam follower and housing with an inlet or outlet port which is capable of being quickly installed and removed as a unit with minimum disturbance of engine parts. A defective module may be replaced quickly with a new module and discarded, returned to a central manufacturing source for rebuilding or repaired locally as desired. In any event, the on site time and effort required to cure a defective valve problem in accordance with this invention is reduced to a minimum.

It is an important object of this invention to provide a novel pre-assembled valve mechanism adapted to be operably installed and removed as a modular unit.

It is another important object of this invention to provide a modular valve assembly useful for intake or exhaust valve functions in internal combustion engines, pumps and like applications.

Still another object of this invention is to provide a valve assembly in the form of a readily replaceable module having particular use in valve regulated mechanisms such as internal combustion engines and pumps, by way of example.

A still further important object of this invention is to provide an novel valve mechanism which promotes improved economies of production, repair and installation.

Having described this invention the above and further objects, features and advantages thereof will be recognized by those familiar with the art from the following detailed description of a preferred embodiment thereof, illustrated in the accompanying drawings and representing the best mode presently contemplated for enabling those skilled in the art to practice this invention.

IN THE DRAWINGS:

FIG. 5 is an enlarged longitudinal cross sectional view of the valve assembly of this invention divorced from the engine of FIGS. 1 and 3;

FIG. 6 is a longitudinal cross sectional view of the valve body seen in FIG. 5;

FIG. 7 is a cross sectional view of the valve guide shown in FIG. 5;

FIG. 8 is a side elevational view of the return spring shown in cross section in FIG. 5;

FIG. 9 is a side elevational view of the valve shown in section in FIG. 5;

FIG. 10 is a cross sectional view of the valve cam follower taken substantially along vantage line 10—10 of FIG. 11 and looking in the direction of the arrows thereon;

FIG. 11 is a top plan view of the cam follower;

FIG. 12 is a right hand end elevational view of the valve cam follower shown in FIG. 11;

DESCRIPTION OF THE PREFERRED EMBODIMENT

Figure 1:
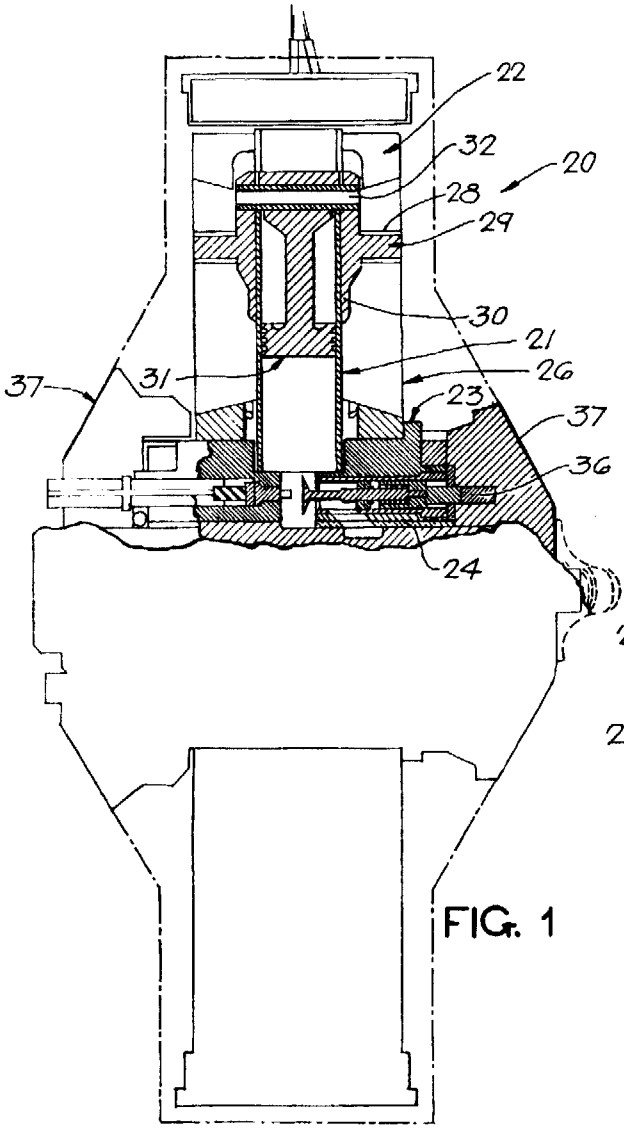
FIG. 1 is a partial elevational view with portions thereof in section of a rotary engine embodying the improved valve assembly of this invention.
Figure 13:
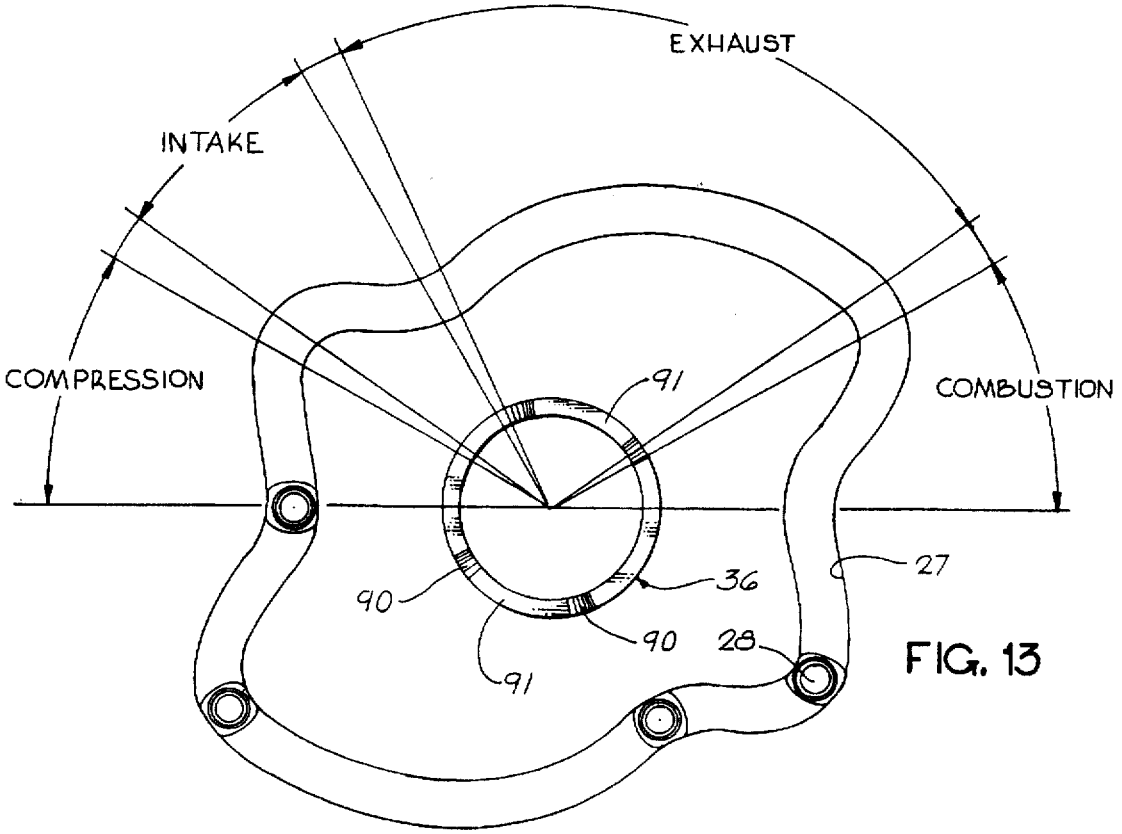
FIG. 13 is a schematic view showing the relationship of valve and cylinder actuating cams of the engine illustrated in FIGS. 1 and 3.

Turning now to the preferred embodiment of this invention, illustrated in the drawings, initial references is made to FIG. 1 wherein a partial showing of a rotary cam plate type engine is indicated generally at 20 comprising a plurality of cylinders 21 carried radially of a rotor 22 for movement with the rotor and a central, generally cylindrical combustion chamber member 23 that is supported on a main bearing 24 concentrically surrounding a stationary main shaft 25. (See FIG. 2) Two parallel, stationary cam plates (not shown) having recessed cam tracks 27 (see FIG. 13) are disposed adjacent opposite axial ends of the rotor 22 to engage cam followers 28, rotatably mounted on pintles 29 extending coaxially from opposite sides of a generally cylindrical saddle means 30. The saddle is moveable over the exterior of cylinder 21 and is connected to a related piston 31 by means of a wrist pin 32 whereby the piston may be reciprocated in response to movement of the rotor and saddle in accordance with the configuration of the cam tracks 27.

A rotary engine having the general features and characteristics of engine 20 hereof is described more fully in my U.S. Pat. No. 4,653,438 issued Mar. 31, 1987. It is to be understood, however, that the particulars of engine 20 are not pertinent to the present invention other than to provide a context in which the novel valve assembly 34 hereof finds useful application. As seen in FIGS. 1–4, the embodiment of valve assembly 34 is employed as an exhaust valve in engine 20.

With reference now to FIGS. 1–4 of the drawings, the features of valve assembly 34 will be described more fully.

Figure 2:
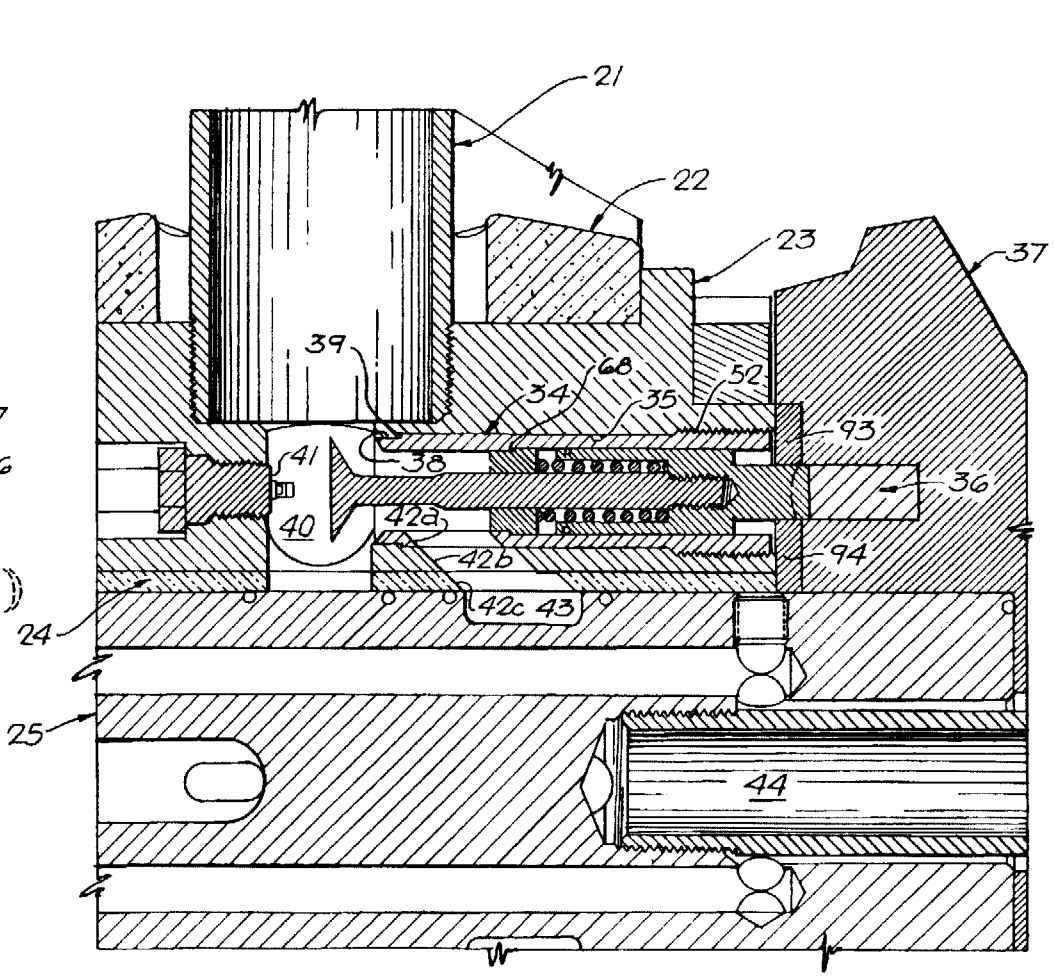
FIG. 2 is an enlarged cross section of a portion of the engine illustrated in FIG. 1 showing the valve mechanism of this invention in open position and indicating its relationship to related parts of the engine.
Figure 3:
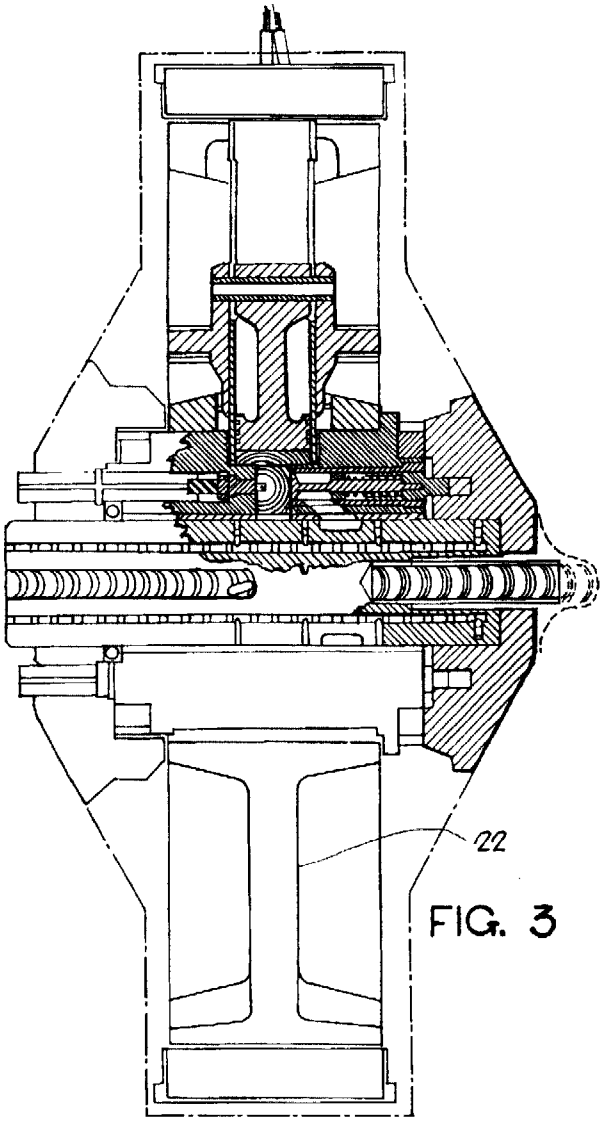
FIG. 3 is a partial elevational view of the engine similar to FIG. 1 with portions thereof in section, showing the valve mechanism of this invention in closed position.

As seen in FIGS. 1 and 2, valve assembly 34 is mounted in a cylindrical bore 35 extending inwardly of one axial end of the combustion chamber member 23 and in opposing alignment with a stationary annular valve cam 36 carried in one end section 37 of a two piece engine housing, (partially shown in FIGS. 1 and 3). It will be noted that bore 35 has a reduced diameter portion 38 at its inner end forming an annular shoulder which is abutted by a mating annular stop shoulder 39 at the operationally inner end of the valve assembly 34 for reasons to appear presently. Bore 38 openly communicates with a combustion chamber 40 within member 23 that in turn openly communicates with the inner radial end of a combustion cylinder 21 individually associated with chamber 40; there being several such chambers 40 in member 23 corresponding to the number of engine cylinders. Each combustion chamber 40 is invaded on one side by a spark plug 41 and on its opposite side by a valve assembly 34. In this instance, the valve assembly serves to control the flow of exhaust gases from the combustion chamber 40 via communicating ports 42*a*, 42*b* and 42*c* and passageway 43 of shaft 25 leading to an exhaust outlet 44 extending coaxially of such shaft.

Figure 4:
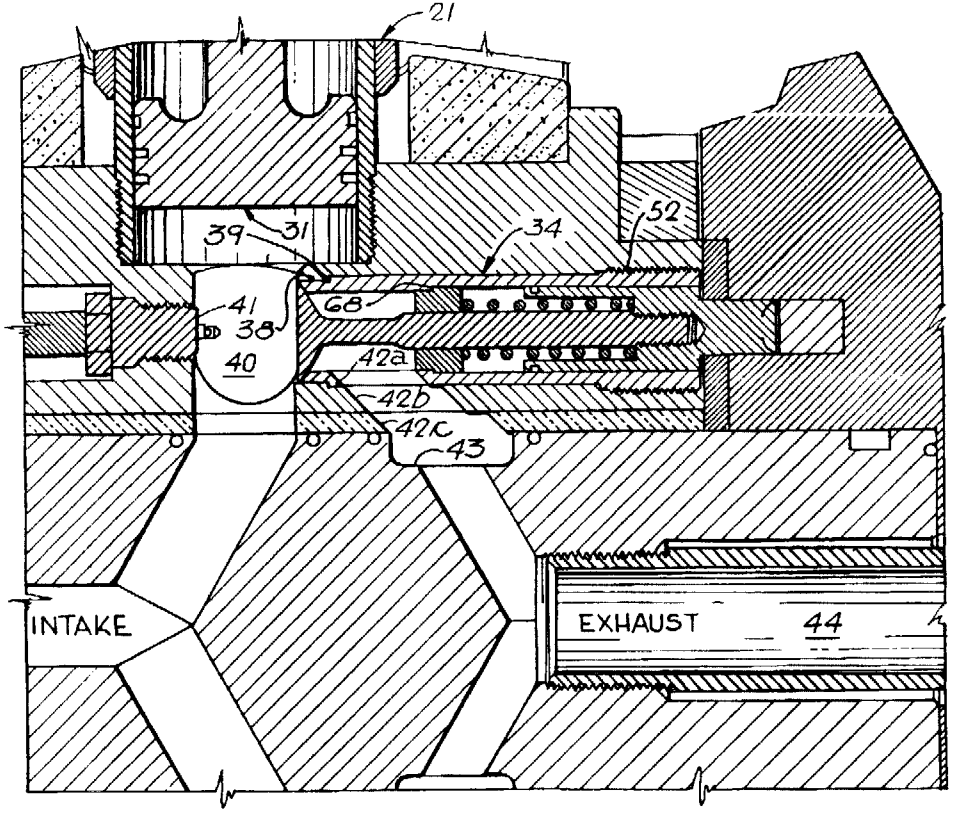
FIG. 4 is an enlarged partial cross sectional view of the engine illustrated in FIG. 3 and showing the relationship of parts for the valve mechanism of this invention in closed position.

As shown in FIG. 5 valve assembly 34 is generally cylindrical with it's various component parts coaxially arranged within a unitary cylindrical housing 50. It will be recognized from sectional view FIG. 6 that housing 50 has a cylindrical body 51 with exterior threads 52 adjacent one outer end 53 thereof. A cylindrical bore 54 extends axially inwardly of end 53 and is provided with a pair of diametrically opposed slots 55, 55 receptive of a spanner wrench for rotatably engaging threads 52 with the internal threads formed in bore 35 of the combustion chamber member 23 whereby to mount the assembly 34 in the engine 20 (FIGS. 1 and 4).

In this regard, engagement of shoulder 39 adjacent the inner end of body 51, with the opposing shoulder formed by the reduced diameter portion 38 in bore 35, serves to limit threading advance of body 51 into bore 35. This limit defined by stop shoulder 39 also assures proper alignment of port 42*a* with port 42*b* of the exhaust ports and passageway as above described.

Bore 54 intersects a smaller diameter coaxial bore 56 extending inwardly of the opposite or operationally inner end 57 of the assembly body 51; the junction between the two bores 54 and 56 forming an internal annular shoulder 58 in body 51, the purpose of which will be explained more fully hereinafter. Port opening 42*a* is formed through the side wall of bore 56 for passage of exhaust gases through ports 42*b* in chamber member 23 and 42*c* in the main bearing 24 to passageway 43 communicating with the shaft exhaust outlet 44 as previously mentioned. The inner end 57 of the body 51 is distinguished by a frustro-conical annular valve seat 59 which cooperates with valve 60.

As shown in FIG. 9, valve 60 comprises an elongated, ground cylindrical stem 61, having a reduced exteriorly threaded tail portion 62 at one end thereof, and an enlarged mushroom head 63 at its opposite end. The valve head 63 is provided with a frustro-conical seat 64 which is matingly engageable with the valve seat 59 at the outer end of the housing for the purposes of periodically opening and closing the inner end 57 of the body 51.

An annular valve guide 65 is shown in FIG. 7 to comprise a cylindrical sleeve body 66 having a reduced diameter portion 67 at one end to form an annular shoulder 68 about the body's exterior. The exterior diameter of body 66 fits closely within bore 54 of the housing 50 while the exterior diameter of portion 67 thereof fits closely within the smaller bore 56 of the housing body with annular shoulder 68 thereabout engaging shoulder 58 of the housing body 51. A cylindrical bore 69 extends coaxially through body 66 and is dimensioned to closely receive the valve stem 61 therethrough for guiding the valve during its movements coaxially of the housing 50.

As shown in FIG. 8 a coil spring 70 surrounds the valve stem 61 with one end 71 thereof abuttingly engaging an adjacently opposing end face 72 of the valve guide (see FIG. 5). The major portion of spring 70 fits closely within a cylindrical blind socket 73 extending axially inwardly of an operationally inner end 74 of a valve cam follower member 80 (see FIGS. 10–12). It will be noted that the other end 75 of spring 70 bottoms against the end wall 76 of socket 73 and that a threaded bore 77 extends coaxially beyond end wall 76.

Cam follower 80 has a generally cylindrical body 81 provided with a radially inset annular kerf 82 formed adjacent its inner end 74 and is further distinguished by an axially extending cam engageable tail portion 83 at its opposite end. Portion 83 is formed with a pair of arcuate top and bottom faces 84 and 85, respectively, which are laterally intersected by angularly convergent planar faces 86, 86 and a transversely related planar outer end face 87 (see FIGS. 11 and 12). The two angular faces 86, 86 serve to engage risers 90 of the valve cam 36 while the end face 87 of the follower periodically engages spaced lobes 91 of the valve cam in operation (see FIGS. 13–15).

With particular reference now to FIG. 5, the organization of the several parts of the unified assembly 34 will be apparent. As there shown, the cylindrical housing 50 is first fitted with the valve guide 65 by inserting the same coaxially into bore 54 until shoulder 68 engages shoulder 58 at the junction of the two bores 54 and 56. This interengagement of the shoulders provides a substantially gas-tight fit.

Once the guide 65 is in place, spring 70 is inserted into the blind bore chamber 73 of the cam follower 80. It is to be noted that the kerf 82 of the cam follower is fitted with an O-ring seal 92, as shown in FIG. 5. The sub-assembly of the cam follower, spring and O-ring is then inserted into bore 54 of the housing so that end 71 of spring 70 engages and wall 72 of the guide sleeve 65. Next the valve 60 is inserted axially through bore 56, the guide sleeve bore 69 and the open interior of spring 70 until the threaded tail portion 62 thereof engages the threaded opening 77 in the cam follower. The valve is then rotated to thread the tail portion 62 into the threaded bore 77, slightly compressing spring 70 and drawing the cam follower 80 into its FIG. 5 position to complete assembly 34.

The unified assembly 34 is readily mounted in operating position in an engine such as engine 20 illustrated, for example, by inserting the same into combustion chamber bore 35 and engaging threads 52 on the exterior of the assembly housing with the internal threads, adjacent the outer end of bore 35 (see FIGS. 2 and 4). The spanner wrench slots 55 are available to tighten the valve assembly into its operating position where at the abuttment of stop shoulder 39 with the shoulder formed by reduced diameter 38 of bore 35 effects a substantially gas-tight seal, preventing hot exhaust gasses from reaching threads 52 which could freeze assembly 34 in bore 35. Rotational alignment of the valve, particularly the valve cam follower, is accomplished by two annular thrust bearings 93 and 94 mounted in housing 37 and disposed above and below the follower portion 83 to closely engage the arcuate surfaces 84 and 85 thereon. In this latter respect, surface 84 is convex while surface 85 is concave; such surfaces being formed at different radii to fit the inner radius of the larger or upper ring bearing 93 and the outer radius of the smaller or inner ring bearing 94.

Figure 14:
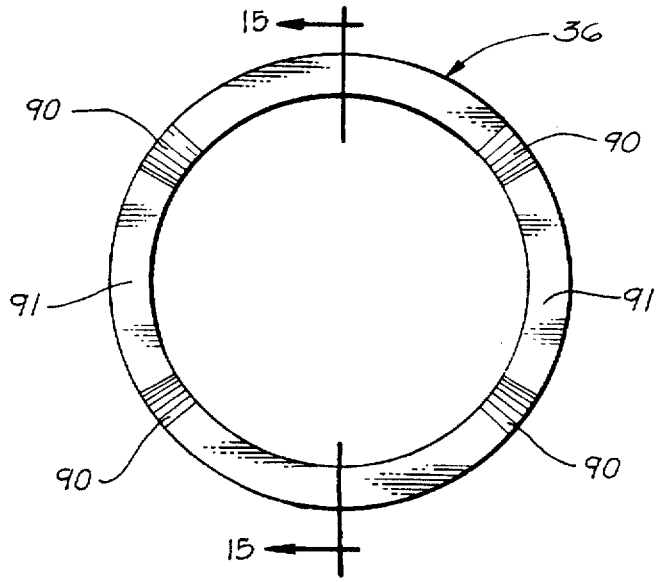
FIG. 14 is an enlarged top plan view of the valve cam shown in FIG. 13.
Figure 15:
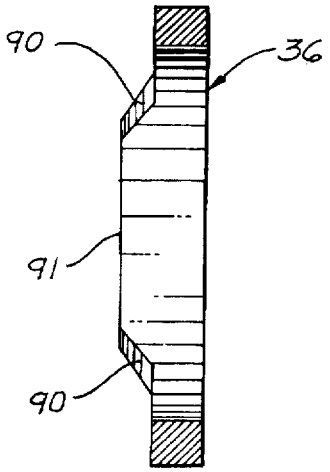
FIG. 15 is a cross sectional view taken substantially along vantage line 15—15 of FIG. 14 and looking in the direction of the arrows thereon.

It will be appreciated from FIGS. 14–15 that movement of the valve follower 80 past or off of a lobe 91 of the valve cam serves to expand spring 70 causing the valve 60 to move axially from its open position of FIG. 2 to its closed position as shown in FIG. 4. Conversely, the valve returns to its open position when the follower engages a riser 90 and raised cam lobe 91 (see FIGS. 2 and 13–15).

From the foregoing it is believed that those familiar with the art will readily understand and appreciate the novel advancement of the present invention and will recognize that while the same has herein been disclosed in relation to a particular described and illustrated preferred embodiment thereof, the same is nevertheless susceptible to modification, variation and substitution of equivalents without departing from the spirit and scope thereof which is intended to be unlimited by the foregoing except as may appear in the following appended claims.

The embodiments of the invention in which an exclusive property or privilege is claimed are defined as follows:

1. A modular, pre-assembled valve assembly designed to be installed and removed as a unit comprising:

a generally cylindrical housing having a lateral gas port and an adjacent valve seat constructed to be removably and insertably secured completely within a mating socket formed in an external support, of an engine block;

a valve having an elongated stem and a valve head cooperable with said valve seat;

a stationary valve guide insertible into and supported on an interior wall portion within said housing to support said stem for coaxial movements therewithin;

an axially moveable cam follower slidably disposed within said housing and engageable with a valve actuating cam located externally of said housing, and a spring extending between an interior cylindrical blind socket within said cam follower for slidably receiving a major portion of said spring therein and one end of said guide for biasing said valve head against said seat whereby, said cylindrical housing is easily inserted into and removed from said engine block mating socket along with said valve guide, said spring, said cam follower, said valve head, said valve seat and said valve stem as a single unit simultaneously.

2. A modular, unitary valve assembly actuated by an external valve cam, comprising in combination:

an elongated generally cylindrical housing having an axially extending cylindrical interior with a frustro-conical valve seat at one end thereof;

said housing having external threads at its other end for effecting threaded assembling completely into and disassembling from a mating socket formed in an external support of an engine block;

an annular valve guide insertible into and supported on a wall portion of said interior;

a cam follower slidably mounted within said interior in axially spaced relation with said valve guide comprising a tail portion extending outwardly of said the other end of said housing for operatively engaging the external valve cam;

a spring extending between and engaging one end of said guide and an interior cylindrical blind socket within said cam follower for slidably receiving a major portion of said spring therein; and a valve comprising a head matingly engageable with said valve seat and having an elongated stem extending coaxially through said valve guide and said spring and detachably connected with said cam follower whereby, said cylindrical housing is easily inserted into and removed from said engine block mating socket along with said valve guide, said spring, said cam follower, said valve head, said valve seat and said valve stem as a single unit simultaneously.

3. The combination of claim 2, wherein said housing has a lateral port communicating with said interior.

4. The combination of claim 2, wherein said follower has an internally threaded socket and the valve's stem has an externally threaded end portion connectable with said socket.

5. The combination of claim 2 wherein said cylindrical interior of said housing comprises a pair of axial bores of different diameters extending from opposite ends of said housing to form an annular shoulder at the intersection of said bores for engageably locating said valve guide in said interior.

6. The combination of claim 5, wherein said valve guide comprises an annulus insertibly engageable with said bores and having an external shoulder abuttable with said annular shoulder to effect a substantially gas tight seal therebetween.

7. The combination of claim 6, wherein said external threads serve to detachably connect the assembly to an internally threaded mating bore formed in said support.

8. The combination of claim 7, wherein said housing has an external shoulder formed adjacent said one end for abutting a mating shoulder formed internally of said interior adjacent said valve seat whereby to effect a substantially gas tight seal therebetween and limit threaded advance of said housing into said mating bore and align said lateral port with a cooperating passageway in said support.

* * * * *